United States Patent [19]

Kurn

[11] 4,146,884

[45] Mar. 27, 1979

[54] MONITORING SYSTEM

[75] Inventor: Peter A. Kurn, Old Basing, United Kingdom

[73] Assignee: Inductron Limited, Basingstoke, England

[21] Appl. No.: 808,464

[22] Filed: Jun. 21, 1977

[30] Foreign Application Priority Data

Jun. 23, 1976 [GB] United Kingdom ..... 26008/76

[51] Int. Cl.[2] ..... G08B 26/00

[52] U.S. Cl. ..... 340/518; 340/520; 340/524

[58] Field of Search ..... 340/413, 415, 518

[56] References Cited

U.S. PATENT DOCUMENTS

| | | | |
|---|---|---|---|
| 3,138,791 | 6/1964 | Beguin | 340/415 |
| 3,523,278 | 8/1970 | Hinkel | 340/415 X |
| 3,524,185 | 8/1970 | Ehni | 340/415 |
| 3,525,988 | 8/1970 | Linder | 340/415 X |
| 3,603,986 | 9/1971 | Harris | 340/415 |
| 3,665,399 | 5/1972 | Zehr et al. | 340/413 |
| 3,964,302 | 6/1976 | Gordon et al. | 340/518 X |
| 3,965,469 | 6/1976 | Ryan | 340/415 |
| 4,037,199 | 7/1977 | Rozehnal et al. | 340/413 |

*Primary Examiner*—David L. Trafton
*Attorney, Agent, or Firm*—Whittemore, Hulbert & Belknap

[57] ABSTRACT

A series of signals are derived from respective transducers, fault detection switches, cubicle door interlock switches and the like at appropriate places in an industrial plant or apparatus. The signals are taken to a system which monitors them for the presence of a fault indicating signal or other signal of interest. The system has a series of scanner devices which are controlled by a logic circuit so as to scan the signals one after the other in a repetitive sequence. Since the transducers, switches and such may be linked one with another so that, when one is producing a fault signal, others later in the sequence may also produce such a signal, the logic system operates so that when a fault signal is located, a further scanning sequence is gone through so that there is located the first transducer or switch in the sequence which is producing a fault signal. This transducer or switch is then identified by a numeric or alpha-numeric display device.

9 Claims, 2 Drawing Figures

MONITORING SYSTEM

This invention relates to monitoring systems, for example for monitoring the existence of faults in apparatus or monitoring operating stages in a production process.

In the following statements of invention the term "signal of interest" refers to a signal indicating a state the existence of which the monitoring system is looking for. The signal of interest could be, but is not necessarily, a signal indicating a fault in the apparatus or a process being monitored.

According to one aspect of the invention, there is provided a system for monitoring a plurality of signals formed by respective signal sources, the system comprising scanning means having a plurality of inputs for being connected to receive respective ones of said signals, and control means which is connected to the scanning means and is operable for controlling the scanning means such that said inputs are scanned in sequence and, after an input which is receiving a signal of interest has been scanned, scanning occurs from the start of said sequence until there is again being scanned an input which is receiving a signal of interest, the system further including a device for displaying a numeric and/or alphabetic legend, which device is controlled for displaying such a legend which identifies the last-mentioned input.

Advantageously the system comprises means for receiving an alternating electrical energy supply and for providing driving energy for said scanning means, said control means and the display device, the control means including means for deriving from said alternating electrical energy supply a pulse train for controlling the advance of the scanning of said inputs by said scanning means such that said scanning proceeds at a rate which is much greater than the supply frequency.

The alternating electrical supply may be the normal mains supply operating at say 50 Hertz. If the repetition rate of the scanning advance pulses is for example 50 kHz or, even better, 200 kHz, the scanning rate, i.e. the number of scanning steps or advances from one input to the next adjacent input in the sequence undergone per second, would be 50,000 or 200,000 respectively. There might be say 100 signal inputs to be monitored so that the complete scanning cycle is gone through 500 or 2,000 times per second respectively.

The system can further comprise means for deriving an analogue electrical signal which is to be monitored, and changeover means connected to the signal deriving means and said legend displaying device, said control means being connected to the changeover means and being operable for setting it such that said legend displaying device displays the value of said analogue until said input which is receiving a signal of interest has been scanned.

In many pieces of machinery and in most process lines a number of electrical and electro-mechanical interlocks and sequence controls are fitted to direct the correct operation of the equipment. The great complexity of these systems makes fault location progressively more difficult and time consuming.

The system to be described with reference to the accompanying drawings has been designed to provide fast indication and location of a malfunction within the machine or process line. In addition, the system can display information relating to the correct functioning of the equipment. The fault or function information is displayed as a digital readout on "local" or "remote" indicator panels. The described system presents numeric indication only, but facilities for alpha-numeric display could be provided, which may be serialised and presented on alternative indication devices such as T.V. screens and print out units and may include further information such as time, time delay, date and the like. Channel selection could then be used to select any one of a number of systems under inspection for presentation on one display unit (T.V. screen) and may be combined with pictorial presentation of the operational area. The various switches, relays and transducers in the electrical circuit under surveillance are scanned at high speed. In most equipments, there is a particular start-up or process sequence which must take place for correct operation. The system described and illustrated herein continuously monitors the various stages of this sequence and enables the operator (or remote observer) to see the exact state of readiness or function. During correct operation of the process line or machine, an electrical signal relating to output power, line speed, flow, temperature, or other useful information, may be applied to the system and can then be presented continuously in digital form. In the event of an error signal or fault in the circuit, the system automatically and immediately returns to its scanning mode, and presents a numerical indication of the cause of stoppage.

Advantageously, the system is arranged to provide a slowly blinking or rapidly blinking display to differentiate between sequence position or transient fault, and a steady display for the analogue condition.

The system is preferably designed to accept a wide range of input voltages and frequencies and to have a high degree of operational stability.

For a better understanding of the invention and to show how the same may be carried into effect, reference will now be made, by way of example, to the accompanying drawings, in which.

Figure 1:
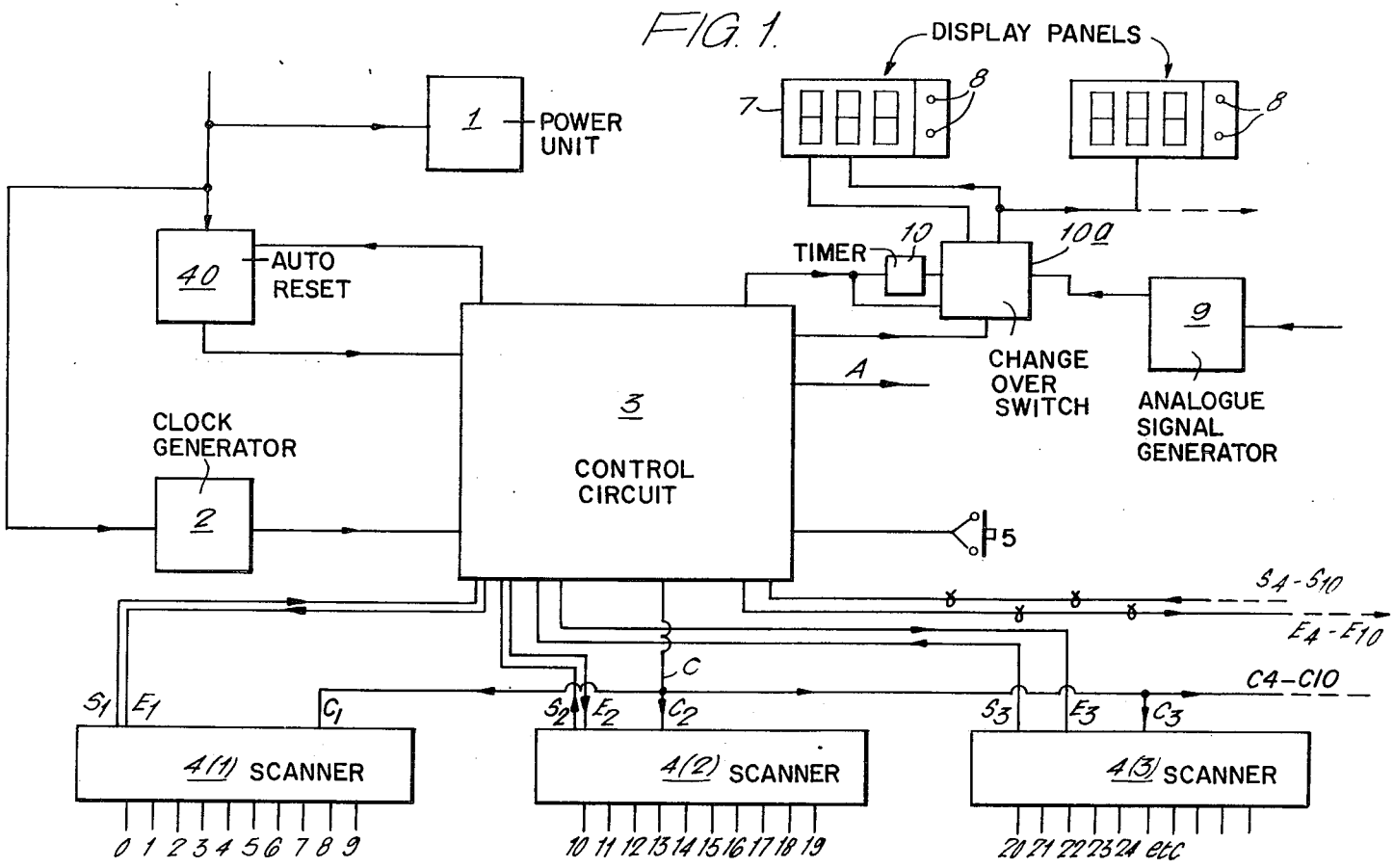
FIG. 1 is a simplified circuit diagram of a fault indicator system.

The system of FIG. 1 may be used, for example, with an industrial plant comprising equipment some of which is housed in cubicles, for example high voltage equipment, and including say a water and/or air cooling system, air conditioning system, peripheral machinery and so on. At various points in the plant there are switches and sensors forming a safety or security interlock system. For example, there can be some switches which are operated by the doors of the various cubicles and cabinets containing high voltage parts of the apparatus. There are also switches controlled in dependence upon water flowing at the correct rate in a cooling system, a switch which indicates whether or not power is being supplied to the control circuits and switches which indicate that the cooling fans, air conditioning apparatus and peripheral machines are operating correctly, and so on. There are also sensors for detecting various overvoltages and like unsafe conditions of the apparatus. The switches and sensors are connected to each other and to the apparatus in a particular sequence which ensures the safe and correct operation of the apparatus. Thus, the water-flow switches ensure that power cannot be applied to the system unless cooling water is flowing. High tension cannot be applied until the appropriate cubicle doors are secure. The number of switches and sensors may be quite considerable, perhaps a 100 or so, and any of them may be in a state which has the ultimate effect of preventing operation of the plant. Also, the switches and sensors are mostly arranged in some series sequence, i.e. the first switch in the sequence, when it is in a "safe" position, passes power to the next switch and when that next switch is in its safe position it passes power to the third switch in the sequence and so on. Thus, if the first switch say is in its unsafe position then all the remaining switches and sensors would also be indicating an unsafe condition. In view of the relative complexity of a safety interlock system, it may become difficult for an operator to know why the apparatus refuses to operate, the first cause of the refusal not being readily apparent.

Therefore, means are provided to indicate exactly where the fault lies. This takes the form of a fault indication system which comprises a series of inputs connected to receive signals indicating a fault or no fault condition of respective ones of the various switches and sensors being monitored. As shown in FIG. 1, the fault indication system comprises a digital signal scanning system.

The following description relates to the use of the illustrated system on a 50 Hertz mains supply system. The system is so constructed that supply frequencies other than 50 Hertz have no detrimental effect since the scanning rate of each component of the system is many times that of the mains supply. The components used are able to operate at much higher speeds than the 50 kHz or 200 kHz previously noted.

The mains supply is taken to a power unit 1 which consists of a transformer and rectifier unit. The output from the rectifier is smoothed and regulated to provide a stable DC supply to the apparatus. An additional remote power supply is used where long distance remote indication is required.

A clock generator 2 derives from the mains supply pulses at a frequency which is much higher than the supply frequency, e.g. for monitoring 100 inputs the frequency may be as low as 5 kHz or as high as 200 kHz, the top limit being determined by the response speed of the logic and the capacitive loading of the interconnecting cables. The output of the clock generator 2 is fed to a control circuit 3 containing logic which sub-divides the clock frequency and then counts the sub-divided frequency signal to give a Binary Coded Decimal (BCD) signal for driving a series of ten scanning devices 4 and local and remote digit display panels 7. The scanning devices include a "units" scanner 4(1) and nine "tens" scanners 4(2)–10) only the scanners 4(1), 4(2) and 4(3) being shown. Further components can be incorporated to extend the system into the "hundreds" or even "thousands", if required.

The scanners 4 each comprise a TTL multi-input Multiplexer.

The scanners are controlled by the BCD signal being fed to their respective control inputs C3 to C10 by way of a common signal line C, so that the inputs of each are switched in sequence to its output S1, S2–S10 respectively. The scanners have "Enable" inputs E1 to E10 respectively by way of which they can be switched into the operative mode in sequence by appropriate signals fed thereto by the control circuit 3. Thus, the inputs of all the scanners will be selected in series sequence in the numerical order 00 to 99.

The outputs from the scanners are connected to the circuit 3 which controls the display panels so that, when a fault signal is received, they display a number which identifies the input receiving this signal.

As mentioned earlier, the interlock switches are connected in series sequence so that, if one of them is in its open state, it is possible that inputs connected to other switches in the sequence may not receive signals. If this occurs while the scanner is "reading" an input which comes after the one corresponding to the first switch in the open state, a false indication may occur. This is overcome by using a re-check feature to ensure that following receipt of a "hold" signal, the scanning proceeds through the re-check and "holds" only on the lowest numbered fault position.

The control circuit comprises a hold circuit for stopping the scanning at the first fault position with the display panels holding a display of the identifying number of that position, the hold circuit being controlled by two bi-stable latches (not shown in FIG. 1) only one of which is operative at any particular time, which one being determined by which of the scanners 4 is in operation. Thus, one or some of the scanners are chosen to be associated with one of the latches and the others are associated with the other latch. Each latch is connected to receive the enable signals fed to the associated scanner so as to put it into operation at the appropriate time. One of the latches is a "manual reset" latch connected to a manual reset push button switch 5 so that, when a fault signal has been received at a scanner associated with this latch, the monitoring system can be manually reset. The other latch has a reset input connected to an automatic reset circuit 6 which, when the appropriate latch is operative, is made operable by the control circuit 3 to provide reset signals at intervals derived from a division of the supply frequency. This auto reset signal is also arranged to modulate the display panel signal causing a "blink" which identifies the then display number as an auto reset position, (the manual reset positions can be arranged to blink at a different rate). The manual reset bi-stable operates a reed switch contained in the control circuit 3 which in turn via control circuit output A operates a relay (not shown) to provide alarm or trip signals. While the system is scanning without being held at any stage, a blanking signal is derived from the bi-stable latches to prevent any indication appearing. A time delay circuit 10 detects this signal which, if held for a predetermined time, operates switching means **10*a* to changeover the display panel inputs to the output from another source such as an analogue device 9 providing a signal representative of some value Y which it would be useful to display. The devices also cause indicator lamps 8 provided on the display panels to indicate that the analogue value is being displayed rather than a fault input identification. The blanking signal is also fed to the display panel via the switching means 10*a*** so that this is turned off when the analogue value Y is displayed. While the Hold system is clear, the display panels continue to indicate the alternative output. However, a fault signal will immediately revert the system to the "Hold" indication.

There could be provided just the local display panel or, as illustrated, the information panel may be repeated at one or more remote positions, each needing only to be fed with the BCD Data either through light duty multicore cables or any other suitable data transmission system.

The "information" data available at the stages being scanned may vary in voltage, but will in general be alternating at supply frequency. However the system is preferably constructed so that +DC or −DC volts are accepted equally well and a large range of input voltages can be accepted. Resistors can be provided at the scanner inputs to limit the input currents to a safe value.

Figure 2:
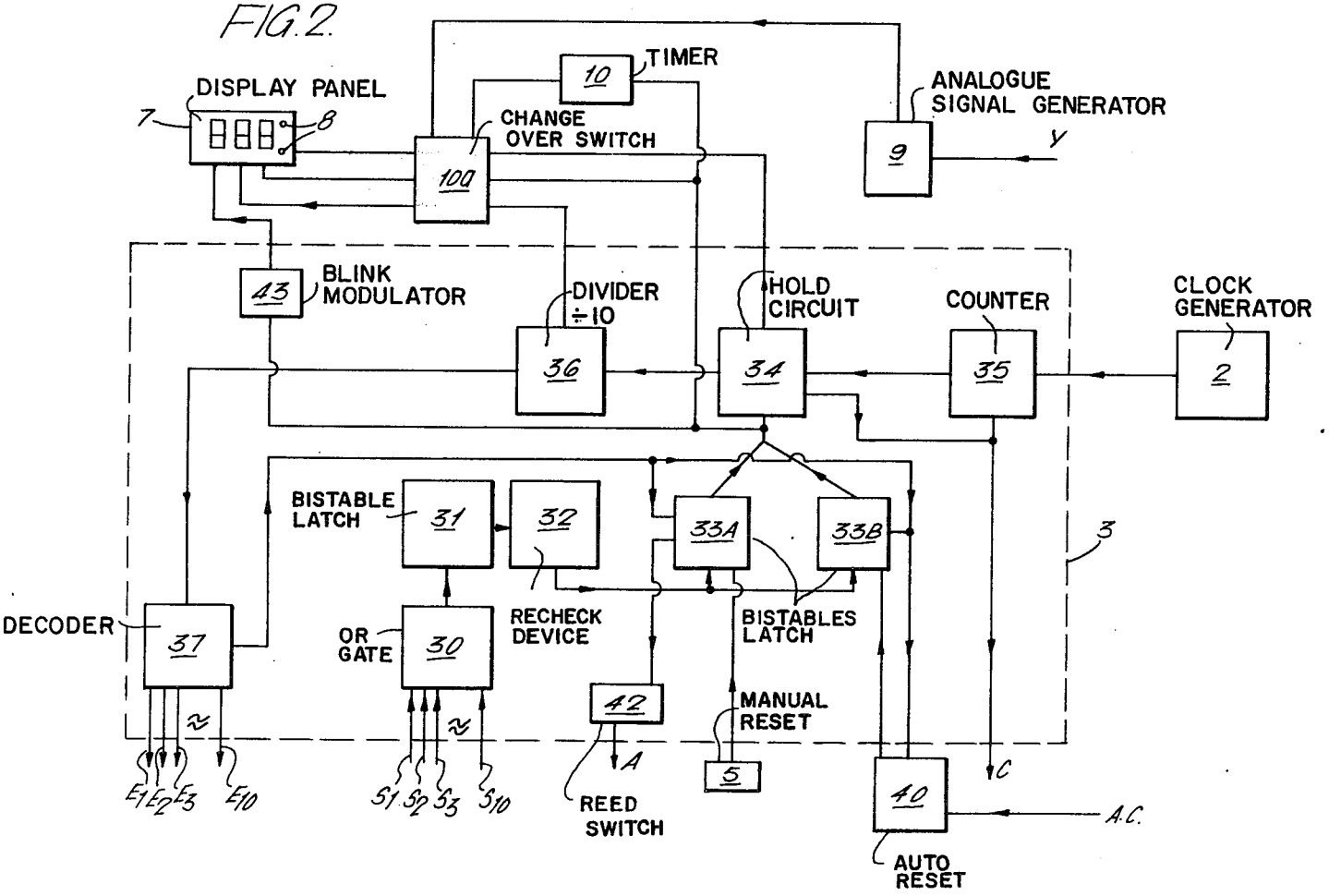
FIG. 2 is a more detailed circuit diagram of parts of the FIG. 1 system.

Referring now to FIG. 2, which shows in more detail the control circuit 3 of FIG. 1, this comprises a multiple input "OR" gate 30 of which the inputs are connected to respective outputs of the scanners 4 and of which the output is connected to the "set" input of a bi-stable latch 31. The output of the bi-stable latch 31 is fed by way of a re-check device 32 to the "set" inputs of two more bi-stable latches 33*a* and 33*b*. The outputs of the two latches 33*a* and 33*b* are combined and connected to a control input of a hold circuit 34. The hold circuit 34 has inputs connected to the "content" outputs of a counter 35, which is driven by the clock generator 2, and outputs connected to the control inputs C of the scanners 4, the "units" digit of the display panel 7 and to a divide-by-ten device 36. The output of the divide-by-ten device is connected to the "tens" digit of the display panel 7 and to a decimal decoder 37 having a series of outputs connected to the "enable" inputs E of respective ones of the scanners 4.

Initially, the BCD signal representative of the content of the counter 35, which counts the pulses from the clock generator 2, is passed through the hold circuit 34 to the "units" digit of the display panel 7 and the scanners 4 and by way of the divide-by-ten device 36 to the "tens" digit of the display panel 7 and to the decimal decoder 37. While the counter 35 receives the first 9 pulses, the decoder 37 produces an output on that one of its outputs which is connected to the "enable" input of the "units" scanner, so the fault signal inputs of this scanner are connected in turn to its output and hence to the "OR" gate 30. When the tenth pulse from the clock generator 2 arrives at the counter, and during the time of receiving the next nine pulses, the decoder 37 produces an output on that one of its outputs which is connected to the "enable" input of the first "tens" scanner. Hence, the fault signal inputs of this scanner, i.e. those identified by the numerals 10 to 19 are selected in turn. The second "tens" scanner is then selected and then the third and so on so that the fault signal inputs of all the scanners are selected or "scanned" in the sequence from 0 to 99. Should one of the fault signal inputs be receiving a fault signal, when this input is selected, the fault signal passes by way of the "OR" gate 30 to the "set" input of the bi-stable latch 31. The scanning operation then continues to its end, i.e. to the selection of input 99. As the scanning sequence restarts, the latch 31 is reset by a signal derived from the ninth or last "tens" scanner. At this point, therefore, the re-check device 32 will have received one pulse from the latch 31 which pulse started at the time of scanning the input which is receiving a fault signal and ended at the end of the scanning sequence. The scanning now continues from the beginning until there is scanned the first input in the sequence which is receiving a fault signal (which input may or may not be the input at which a fault signal was detected during the preceding sequence). This present fault signal again passes through the "OR" gate 30 to set the latch 31. The resultant pulse passed to the re-check device 32 being the second such pulse, causes the device 32 to produce an output signal which is passed to the "set" inputs of the two latches 33*a* and 33*b*.

As will be described later, only one of the two latches 33*a* and 33*b* is operative at any particular time, which one being determined by the decimal decoder 37. Whichever, one is operative at the time of receipt of the signal from the divide-by-two device is set thereby and hence produces an output signal which passes to the hold circuit 34 and causes it to hold, as its outputs, the signals which it is then receiving from the counter 35. As a result, the scanning operation is held at the first input in the sequence which is receiving a fault signal.

The display panel 7 receives a blanking control signal from the bi-stable latches 33*a* and 33*b* such that when the operative one of the latches 33*a* and 33*b* produces a signal which closes hold circuit 34 and thus holds the scanning operation, the display devices are unblanked so that these then display the number which identifies the scanner input at which the scanning sequence has become held.

The two latches 33*a* and 33*b* are connnected to receive respective control signals from the decoder 37 so that while the inputs of the selected scanners are being scanned, only the latch 33*a* is operative and, while the inputs of the remaining scanners are being scanned, only the latch 33*b* is operative. The latch 33*a* has a reset input connected to a "manual reset" push button 5 while the latch 33*b* has a reset input connected to the output of an automatic reset circuit 40 which comprises a divider connected to the output of a 50 Hz shaping circuit and a control input connected to receive the same control signal from the decoder 37 which makes the latch 33*b* operative or inoperative. Thus, the reset circuit 40 is only operative when the latch 33*b* is operative.

When it is operative the reset circuit 40 produces reset pulses at predetermined intervals under the control of the mains input received via the 50 Hz shaper. Thus, if the scanning operation is held as a result of a fault signal appearing at an input of a scanner which is associated with the latch 33*b*, resetting of the system takes place by means of the automatic reset circuit 40 while, if the hold is a result of a fault signal appearing at any other input, reset can only take place by means of the manual reset push-button 39.

The set output of the latch 33*a* is connected to a reed switch 42 which controls external facilities such as an alarm or trip system required to become operative when a "manual reset" fault is detected.

The above-described features of the fault indicator system are intended to take account of certain conditions which may arise, for example during the start-up procedure of the apparatus which the system is arranged to monitor. By way of example, suppose that an apparatus is being started up and the necessary sequence of switching the various parts of the apparatus on has reached the stage where the power for a heater has just been turned on but the heater has not yet warmed up sufficiently for the process to be started. Under these conditions the heater timer will produce a fault signal at the corresponding scanner input. The identifying number of this input will thus be displayed by the display panel 7 to indicate to the operator the reason for the hold-up in the start-up procedure. However, this hold-up is not due to a fault in the sense that something has to be done by the operator before the hold-up disappears. He merely has to wait until the heater has warmed up, as determined by the timer, and then the timer will cease to produce a fault signal at the corresponding scanner input and the start-up procedure for the apparatus will continue to the next stage. This input therefore is made one of those for which the automatic reset circuit 40 is operative. The fact that this is an automatic reset fault is indicated to the operator by the blinking of the displayed fault input identification number.

Should the circuit 40 reset the latch 33*b* whilst the heater timer is still producing a fault signal, the scanning operation will proceed but, since the fault signal is still present, it will quickly become held again with the same input number displayed. The scanning operation is so fast that this repetition will not be discernible.

For those fault inputs for which the manual reset circuit is operative, the display panel gives a different blink rate display of the number identifying whatever the fault is, indicating to the operator that some action is required.

The circuitry for providing such blinking of the display is not shown in detail but can comprise any suitable arrangement, for example a device 43 which provides a modulated blanking signal to the display panel under the control of the latches 33*a* and 33*b*.

The re-check device 32 can comprise a simple counter which gives one pulse out for each two successive pulses received.

I claim:

1. A system for monitoring a plurality of signals formed by respective signal sources, the system comprising scanning means having a control input and an output, and having a plurality of inputs for being connected to receive respective ones of said signals, control means which is connected to the scanning means and is operable for forming control signals for controlling the scanning means, the scanning means being operable for continuously scanning its inputs to connect them in predetermined sequence to said output under the control of said control signals applied to said control input by said control means, the control means including detecting means connected to said output of said scanning means and operable for detecting the scanning of an input which is receiving a signal of interest, for then causing the control means to produce such control signals that scanning continues through the start of said sequence until there is scanned that one of any of said inputs receiving signals of interest which comes first in said sequence, and for then causing the control means to stop said scanning with that one input held, the system further including a display device for displaying a numeric and/or alphabetic legend, which device is connected to said control means and is operable for being controlled by the control means to display a legend which identifies only the said that one input.

2. A system according to claim 1, including drive means having an input for receiving an alternating electrical energy supply and an output connected to said scanning means, said control means and the displaying device for providing driving energy thereto, the said control means including means for deriving from said alternating electrical energy supply a pulse train for controlling the advance of the scanning of said inputs by said scanning means such that said scanning proceeds at a rate which is much greater than the supply frequency.

3. A system according to claim 1, including signal deriving means for deriving an analogue electrical signal which is to be monitored and changeover means connected to the signal deriving means and said legend displaying device, said control means being connected to the changeover means and being operable for setting it such that said legend displaying device displays the value of said analogue until the said that one input which is receiving a signal of interest has been scanned.

4. A system according to claim 3, wherein the control means is operable for causing the legend displaying device to give a steady display when it is displaying the value of said analogue and to give a display which flashes on and off repeatedly when a legend identifying an input at which a signal of interest has been received is being displayed.

5. A system for monitoring a plurality of signals formed by respective signal sources, the system comprising scanning means having a control input and an output, and having a plurality of inputs for being connected to receive respective ones of said signals, control means which is connected to the scanning means and is operable for forming control signals for controlling the scanning means, the scanning means being operable for scanning its inputs to connect them sequentially to said output under the control of said control signals applied to said control input by said control means, the control means including detecting means connected to said output of said scanning means and operable for detecting the scanning of an input which is receiving a signal of interest and for then causing the control means to produce such control signals that scanning occurs from the start of said sequence until there is again being scanned an input which is receiving a signal of interest, the system further including a display device for displaying a numeric and/or alphabetic legend, which device is connected to said control means and is operable for being controlled by the control means to display a legend which identifies the last-mentioned input and said control means being further operable for causing the legend displaying device to give a display which flashes on and off repeatedly at one of two different speeds, one speed being associated with some of said inputs and the other being associated with the others of said inputs.

6. A system according to claim 1, wherein said scanning means comprises a plurality of scanning devices each with a plurality of inputs which are scanned under the control of signals applied to the device by said control means, the scanning devices comprising respective enable inputs to which are applied by the control means respective enable signals in sequence so that an enable signal is applied to the first scanning device in the sequence and the inputs of this device are scanned under the control of the said control signals applied to this device by the control means, then an enable signal is applied to the second scanning device in the sequence and its inputs are scanned, and so on.

7. A system for monitoring a plurality of signals formed by respective signal sources, the system comprising scanning means having a control input and an output, and having a plurality of inputs for being connected to receive respective ones of said signals, a display device for displaying a numeric and/or alphabetic legend, control means which is connected to the scanning means and the displaying device and is operable for forming control signals for controlling the scanning means and the displaying device, the scanning means being operable for scanning its inputs to connect them sequentially to said output under the control of said control signals applied to said control input by said control means, and said control means comprising counting and decoding means and counter content hold means which are arranged to control the scanning means and the displaying device, gating means having a plurality of inputs connected to the scanning means for receiving any scanned signals of interest, first bistable latching means connected to the output of the gating means and said counting and decoding means so as to be set upon reception, via said gating means, of a signal of interest from the scanning means and to be re-set at the end of the scanning sequence, re-checking means which is connected to the first bistable latching means and which is arranged for responding to the reception from the first bistable latching means of two set output signals following one after the other to form an output pulse, and second bistable latch means which is connected to said re-checking means and said counter content hold means and is operable upon reception thereby of an output pulse from the re-checking means to cause the counter content hold means to hold the content of said counting and decoding means and thereby to cause the scanning operation to be stopped at the first scanned input in the scanning sequence which is receiving a signal of interest and the legend displaying device to display a legend identifying that scanner input.

8. A system according to claim 7, wherein said second bistable latching means comprises two bistable latches which are controlled by said counting and decoding means so that one is only operative while selected ones of the scanner inputs are being scanned and the other is only operative while the other scanner inputs are being scanned, the system further including manual reset switch means connected to one of the two bistable latches for resetting it, and automatic reset means which is connected only to the other bistable latch and which forms at repeated intervals reset pulses for resetting the said other bistable latch.

9. A system for monitoring a plurality of signals formed by respective signal sources, the system comprising scanning means having a control input and an output, and having a plurality of inputs for being connected to receive respective ones of said signals, control means which is connected to the scanning means and is operable for forming control signals for controlling the scanning means, the scanning means being operable for scanning its inputs to connect them sequentially to said output under the control of said control signals applied to said control input by said control means, the control means including detecting means connected to said output of said scanning means and operable for detecting the scanning of an input which is receiving a signal of interest and for then causing the control means to produce such control signals that scanning occurs from the start of said sequence until there is again being scanned an input which is receiving a signal of interest, the system further including:

a display device for displaying a numeric and/or alphabetic legend, which device is connected to said control means and is operable for being controlled by the control means to display a legend which identifies the last-mentioned input, and power supply means having an input for receiving an electrical energy supply and an output connected to said scanning means, said control means and the displaying device for providing driving power thereto, the said control means including means for deriving from said driving power a pulse train for controlling the advance of the scanning of said inputs by said scanning means.

* * * * *